US006257576B1

(12) United States Patent
Pontacoloni

(10) Patent No.: US 6,257,576 B1
(45) Date of Patent: Jul. 10, 2001

(54) FISHING GAME

(76) Inventor: Edward J. Pontacoloni, 28 Juniper Rd., Windsor, CT (US) 06095-1853

( * ) Notice: Subject to any disclaimer, the term of this patent is extended or adjusted under 35 U.S.C. 154(b) by 0 days.

(21) Appl. No.: 09/167,759

(22) Filed: Oct. 7, 1998

(51) Int. Cl.[7] ..... A63F 3/00

(52) U.S. Cl. ..... 273/244; 273/259

(58) Field of Search ..... 273/236, 244, 273/277, 288, 291, 140, 298

(56) References Cited

U.S. PATENT DOCUMENTS

| | | | |
|---|---|---|---|
| 3,888,189 | * | 6/1975 | Kane . |
| 3,921,981 | | 11/1975 | Ashburn . |
| 4,003,578 | * | 1/1977 | Jones . |
| 5,176,385 | * | 1/1993 | Tagliaferro . |
| 5,186,466 | | 2/1993 | Mudd et al. . |
| 5,314,182 | | 5/1994 | Derr . |
| 5,342,059 | * | 8/1994 | Briem . |
| 5,513,848 | | 5/1996 | Keener . |

* cited by examiner

*Primary Examiner*—Jeanette Chapman
*Assistant Examiner*—Vishu Mendiratta
(74) *Attorney, Agent, or Firm*—Cantor Colburn LLP

(57) ABSTRACT

A novel fishing game for a plurality of players including a game board, playing pieces, playing cards and a die. The game board is arranged into fishing holes for each of up to four players, each fishing hole having playing spaces arranged thereon according to different depths of water. The playing pieces have information printed thereon relating to a type and weight of a particular fish, and also relating to fishing events. The playing cards have information printed thereon relating to fishing bait and lure types. The die includes several faces, each face indicating a depth of water. The playing cards are distributed to each player according to a set of rules. During play a player rolls the die and chooses a playing piece from the player's fishing hole corresponding to the depth of water indicated on the die. The player announces the type and weight of fish, or fishing event, indicated on the playing piece and attempts to match the playing piece to a lure or bait indicated on a tackle card with regard for the depth of the water according to a set of rules. If the type of fish matches the tackle card the player records the weight of the fish. If the playing piece does not match the tackle card the playing piece is returned to the board. The game continues until a fishing hole is depleted of playing pieces. A winner is determined from the tabulated weights of the recorded fish.

2 Claims, 3 Drawing Sheets

FISHING GAME

BACKGROUND OF INVENTION

FIELD OF INVENTION

This invention relates generally to a board game directed at fishing. More specifically this invention relates to a novel fishing board game that incorporates skill, chance and player interplay.

It is well known in the art to utilize dice, and chance cards to advance tokens around a game board. In a typical fishing game of the prior art an 18 inch square and foldable board is printed with graphics including playing squares or a path comprised of spaces. Tokens, sometimes resembling fish or boats, are maneuvered about a path on the game board by players in accordance with instructions give by chance cards and or a roll of a pair of dice in pursuit of increasing the players' scores. Typical fishing games utilize the accumulated weight of fish "caught" during play to determine relative scores among the players. Certain of the squares or spaces are typically associated with events which affect the players' scores such as allowing players the chance to match fish depicted on cards with a lure depicted on the board as disclosed in U.S. Pat. No. 3,921,981. Other typical prior art fishing games which similarly combine the players' moving tokens about the game board and combining rolls of the dice with chance cards include U.S. Pat. Nos. 3,888,489, 4,003,578, 5,186,466, and 5,513,848.

In U.S. Pat. No. 5,186,466 to Mudd a game and board is disclosed wherein players move along a path on the board indicated by the rolling of dice. Along the path of the board the players are directed to two draw either of two types of cards that may add to the player's catch "weight" or detract therefrom. The players keep track of the accumulated weight of the fish caught and the player with the highest amount of weight caught wins.

Similarly, in U.S. Pat. No. 5,513,848 to Keener a game and board is disclosed wherein players also use dice to control the movement of tokens along a path on the game board. The players collect money along the path and certain spaces along the path allow the player to "purchase" tackle, and draw "bite" cards, etc. The weight of fish caught is determined by a roll of the dice and the player with the highest amount of weight wins.

A game and board is also disclosed in U.S. Pat. No. 3,921,981 to Ashburn wherein players again use dice to control the movement of tokens along a path on the game board. Certain spaces along the path allow the players to "cast" wherein the player selects a "lure" and then draws a "bass card". If the card matches the lure the player "keeps" the bass and the weight indicated on the card is added to his score. Also disclosed are the use of chance cards referred to as "fisherman's luck" cards which affect play and scoring.

Although the above described fishing games provide enjoyment and chance none properly simulate the skill required in the practice of actual fishing. Fishing games of the prior art do not allow for play at various levels of ability, various tournament formats, nor do they allow for adequate player interplay.

SUMMARY OF THE INVENTION

The above discussed and other drawbacks and deficiencies of the prior art are overcome or alleviated by the present invention. A novel fishing game for a plurality of players is presented including a game board, playing pieces, playing cards and a die. The game board is arranged into fishing holes for each of up to four players, each fishing hole having playing spaces arranged thereon according to different depths of water. The playing pieces have information printed thereon relating to a type and weight of a particular fish, and also relating to fishing events. The playing cards have information printed thereon relating to fishing bait and lure types. The die includes several faces, each face indicating a depth of water. The playing cards are distributed to each player according to a set of rules. During play a player rolls the die and chooses a playing piece from the player's fishing hole corresponding to the depth of water indicated on the die. The player announces the type and weight of fish, or fishing event, indicated on the playing piece and attempts to match the playing piece to a lure or bait indicated on a tackle card with regard for the depth of the water according to a set of rules. If the type of fish matches the tackle card the player records the weight of the fish. If the playing piece does not match the tackle card the playing piece is returned to the board. Player interplay is achieved through chance opportunities to fish an opponent's fishing hole, or to impede the ability of an opponent to catch a particular fish. The game continues until a fishing hole is depleted of playing pieces. A winner is determined from the tabulated weights of the recorded fish.

The above discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

A game in accordance with the present invention is an entertaining and educational board game for two to four players, intended for players of ages eight to adult, with various fishing skills from beginners to fishing professionals. The present invention includes several embodiments comprising methods of playing a game which includes a game board, playing pieces, a die, playing cards, and a guide book.

Game Board

Figure 1:
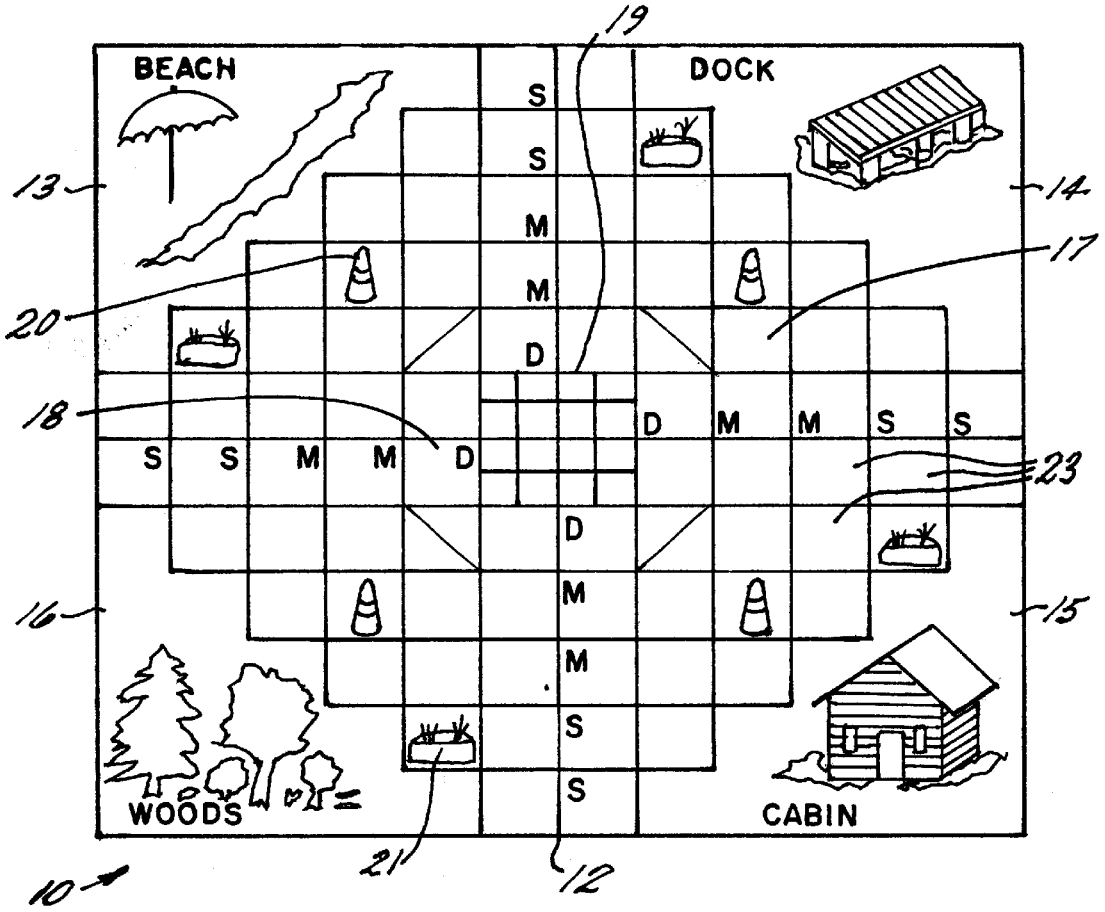
FIG. 1 is a plan view of a game board of the present invention showing the playing squares, fishing squares and shore areas.

An embodiment of a game board in accordance with the present invention is shown in FIG. 1 as 10 and is 18" by 18" of 144 squares each 1½"×1½" and is foldable along a middle crease 12. In each of the four corners of the board 10 is a triangular area representing the shore 13, 14, 15, 16. The center playing area of board 17 is representative of a lake comprised of 84 squares, and is divided into four quadrants, each associated with a shore area 13, 14, 15, 16. Each of the four quadrants has color-coded areas representing "fishing holes" associated with the shore areas. Each of the fishing holes comprises twenty-one squares including seventeen fishing squares which are exclusive to that fishing hole. The fishing squares are comprised of squares representative of different depths of water with five squares designated as shallow, ten squares designated as medium depth, and 2 squares designated as deep. In addition to the exclusive squares each fishing hole shares one deep water square 18 with its adjacent fishing holes, and those four squares are two colored and each fishing hole also shares the center block 19 of four deep water squares with the other three fishing holes. The adjacent deep water squares 18 are two-colored designating the adjacent fishing holes and center squares 19 accordingly are four-colored designating all four fishing holes. Each fishing hole further includes a square representing a buoy 20 and a square representative of a submerged tree 21. The corners of the board 10 include graphics representing shore areas around the lake 17 such as a cabin in shore area 15, a beach in shore area 13, a dock in shore area 14, and woods in shore area 16. In certain embodiments the shore areas may serve as creels for a player's catch as will be more fully described herein below.

Playing Pieces

Figure 2:
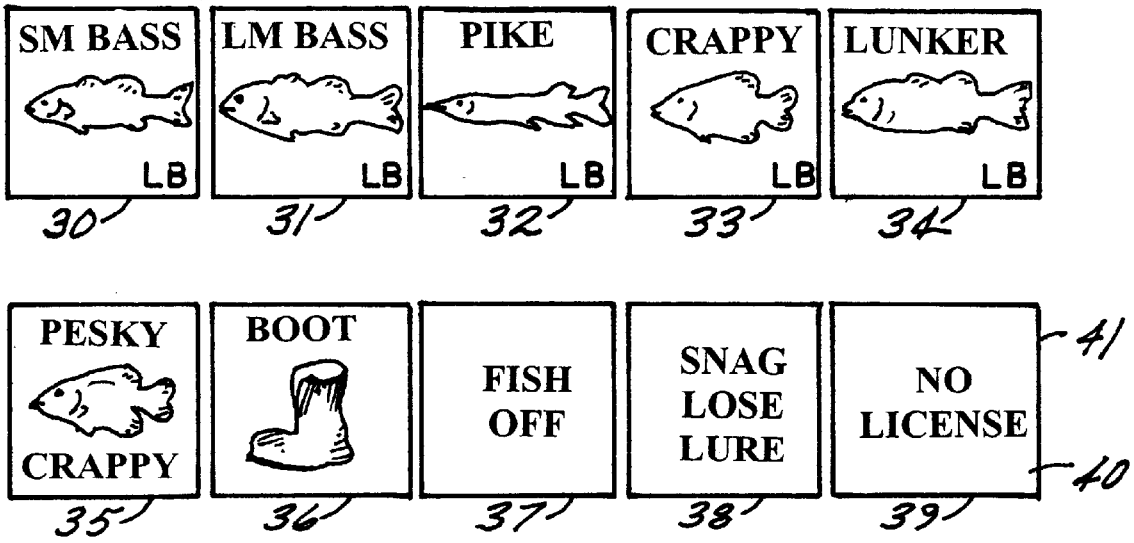
FIG. 2 is a plan view of the various playing pieces of the present invention showing the indicia printed thereon.

Referring to FIG. 2 there is shown playing pieces 30–39 which are placed on the seventeen fishing squares of the four quadrants of board 17. In accordance with the present invention there are seventy six playing pieces, referred to as Fish tiles, or chips, comprised of ⅛" thick plastic approximately 1¼"×1¼" square which are placed face down within the fishing squares on board 17. Also in accordance with the present invention the buoy 20 and the submerged tree 21 squares do not receive a chip. The faces 40 of the seventy six chips incorporate indicia pertaining to fishing events affecting scoring as will be more fully described herein below and include fifty-five fish chips 30–35 and twenty-one event chips 36–39. Specifically there the event chips of the present invention include ten chips 38 having "Snag, Lose Lure" indicia printed on the face; eight chips 37 having "Fish Off" indicia printed on the face; two chips 39 having "No License" indicia printed on the face; and one chip 36 having "Old Boot" indicia printed on the face. The fish chips include indicia printed on the face and various numbers representing weights of the fish including six chips 32 representing Northern Pike of various weights, from four pounds to seven pounds; six chips 32 representing "Lunker" Large Mouth Bass of various weights, from three and one half pounds to six pounds; eleven chips 31 representing average Large Mouth Bass of various weights, from one and one half pounds to three pounds; fifteen chips 30 representing Small Mouth Bass of various weights, from ten ounces to three and one half pounds; twelve chips 33 representing Crappies of various weights, from eight ounces to one and one half pounds; and five chips representing "Pesky Crappies." The hidden underside of each Fish Chip identifies the type of fish and its weight. The topsides 41 of all Fish Chips are identical and in one embodiment includes indicia representing a bass leaping out of water. Once accumulated by a player chips are placed on a designated area of the shore comprising that player's "creel" (not shown).

The Die

Figure 3:
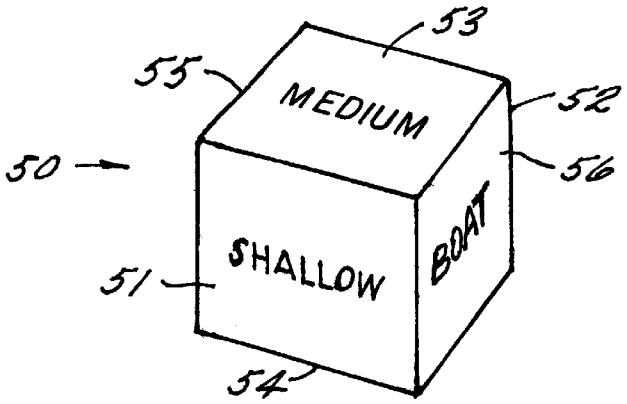
FIG. 3 is an isometric view of a die of the present invention.

There is one die 50 , or six-sided cube as shown in FIG. 3, which has two sides 51, 52 marked for shallow water, two sides 53, 54 marked for medium depth water, one side 55 marked for deep water, and one side 56 marked "Boat". The markings 51–55 direct a player to the corresponding area on game board 17 within that player's specific fishing hole. The Boat marking 56 allows a player access to any fishing square on board 17, except square 22 behind buoy squares 20 or the three squares 23 immediately adjacent to the submerged tree squares 21. In an alternative embodiment a standard die (not shown) may be used, in which case the numbers one and two on the die represent shallow water, three and four represent medium depth water, the number five represents deep water and the number six represent the Boat.

Playing Cards

Figure 4:
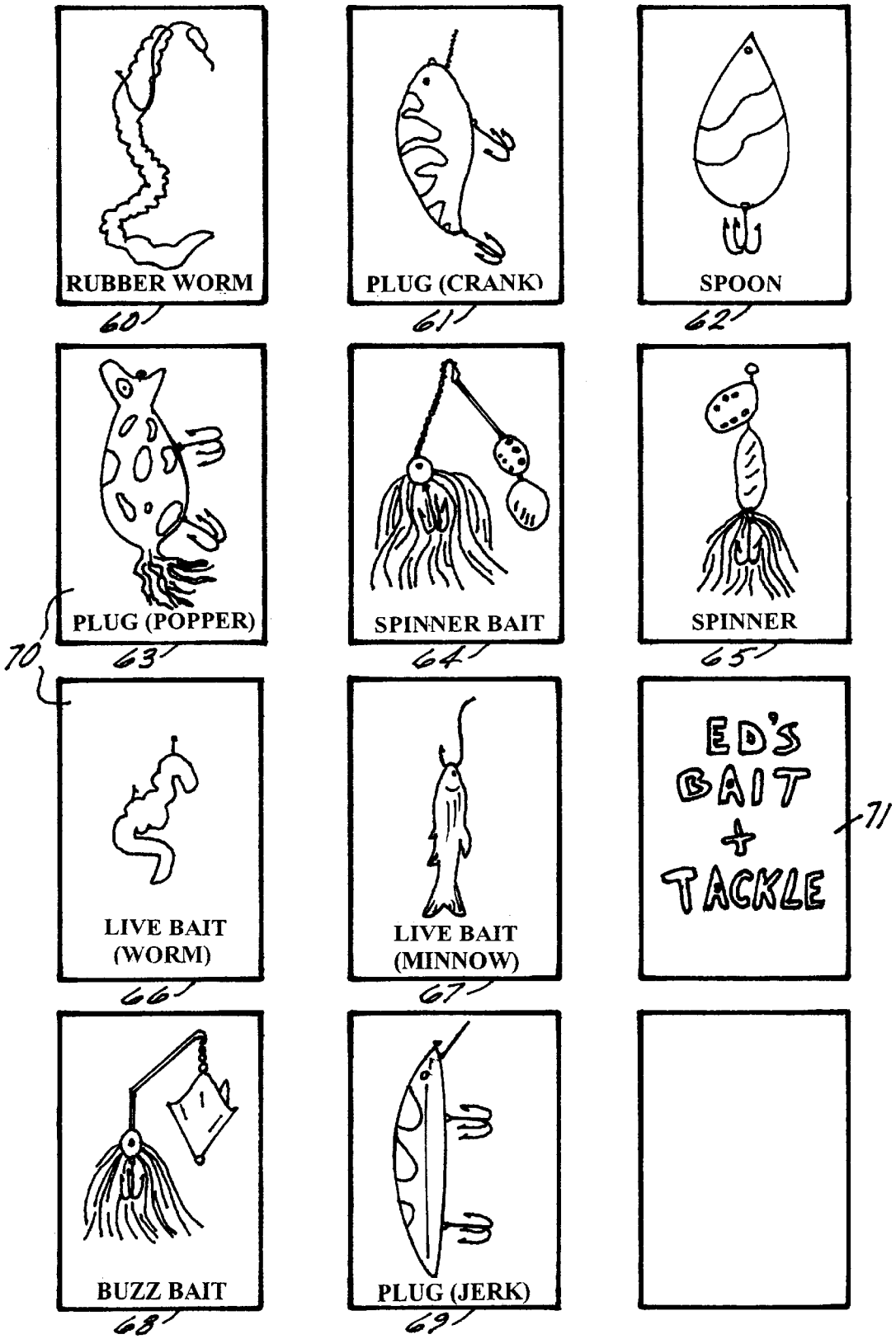
FIG. 4 is a plan view of the various playing cards of the present invention showing the indicia displayed thereon.

Referring to FIG. 4 there are shown playing cards 60–69, referred to as tackle cards, which, in accordance with the present invention are placed face 70 down in a stack during play of the game. The present invention includes fifty-five, 3½×2½" tackle cards having indicia representing various fishing tackle printed on the face 70 corresponding to tackle most appropriate to "catch" any particular fish, depending on the depth of the fishing hole in which a corresponding fish chip is found as will be more fully explained herein below. Indicia printed on the tackle cards include eight "live bait" cards 66 comprising a worm; eight "live bait" cards 67 comprising a small minnow on a hook; eight "rubber worm" cards 60 comprising a standard type rubber worm lure; eight "plug" cards 61, 63, 69 comprising various plugs lures; eight "spinner" cards 65 comprising a standard spinner lure; five "spoon" cards 62 comprising a spoon lure; five "buzz bait" cards 68 comprising a buzz bait lure; and five "spinner bait" cards 64 comprising a spinner bait lure. The backs 71 of lure cards 60–69 are advantageously identical and in one embodiment the title, "Ed's Bait & Tackle" is imprinted thereon. The cards are distributed to the players as will be more fully described herein below and comprise a player's "tackle box".

Fishing Guide

The present invention includes a fishing guide book (not shown) which describes the relationship between real fishing and that represented by play of the present invention in an educational format. The fishing guide includes information pertaining to the types of fish found in the lake as portrayed by fish chips 30–35, their natural habitats such as the depth of water and other information. The fishing guide further describes the tackle represented on playing cards 60–69 as well as methods used to employ the various tackle in genuine fishing events.

General Method of Play

The present invention includes several variations of game play, all of which variously involve placement of fish chips 30–39 on the fishing squares of game board 17; tossing the die 50 to determine the depth of the fishing hole to be fished; selecting and turning over a fish chip corresponding to a square selected for the depth determined; and matching the fish indicated on the chip to an appropriate lure represented on tackle cards 60–69.

In general each player selects a shore area 13–16 and is subsequently assigned the fishing hole corresponding to quadrant which includes that shore area. The players in succession roll die 50 and choose, or fish, a square on game board 17 corresponding to the depth indicated on the die within the player's assigned fishing hole. If a player rolls the die indicating "Boat" 56 that player may fish on any fishing square on the game board, except square 22 behind buoy squares 20 or the three squares 23 immediately adjacent to the submerged tree squares 21. Squares 22, 23 may not be fished from after the roll of the die indicates Boat 56, and thus may only be fished by the player assigned to the corresponding fish hole. Tackle cards 60–69 are arranged in a stack, placed on game board 17, and are randomly distributed to the players as will be more fully described herein below. A player may only catch a fish indicated on a chip occupying the selected square if the player possesses the corresponding tackle card as described in the fishing guide for the particular fish indicated on the chip and the depth at which it is occupying. If the appropriate match is made between fish chip and tackle card the player removes the fish chip from the playing area and places the fish chip on his shore area, and records the weight of the fish caught. Players continue to roll the die in succession until one of the quadrants is devoid of chips. The players then add the weight of the fish they have caught, and the player whose total catch weighs the most, wins.

In accordance with the present invention the following general rules apply, and are further described in the aforementioned fishing guide. The rules are set forth to accurately represent genuine fishing events to depict the requisite skill and luck involved in actual fishing event. A player may catch a Crappie, including a Pesky Crappie, in any depth only with live bait. That is to say that a player, after rolling the die 50 and choosing a chip 33, 35 having a Crappie depicted thereon, may include the weight of the Crappie in that player's creel only if a live bait tackle card 66, 67 is possessed by that player. When a Crappie is caught, the player removes the chip 33, 35 from the board and then the live bait card 66, 67 is returned to the stack of tackle cards. Once the live bait card is returned to the stack the player may draw another lure card 60–69 from the top of the deck immediately before his or her next turn.

In accordance with the present invention a player may catch a small mouth bass or an average large mouth bass in shallow water with a rubber worm; in medium depth water with a plug; or in deep water with a standard spinner. If a player chooses a chip depicting a small mouth bass 30 or an average large mouth bass 31 then the player must also possess the appropriate lure card 60, 61, 63, 69, or 65 for the corresponding depth of water of the space which the chip occupies on the game board 17.

Also in accordance with the present invention a player may catch a northern pike or lunker large mouth bass only in shallow water with a spoon; in medium depth water with a buzz bait; and in deep water with a spinner bait. During play if a player chooses a chip depicting a northern pike 32 or lunker large mouth bass 34 then the player must also possess the appropriate lure card 62, 68, or 65 for the corresponding depth of water which the chip occupied on the game board 17.

If, during play, a player chooses a square occupied by the old boot event chip 36 then that player may select a fish chip from anywhere in the lake regardless of the tackle cards that the player may possess. If the event chip labeled "Fish Off" 37 is chosen by a player there is no catch recorded and the "Fish Off" chip is removed from the board.

If the event chip "Snag, Loose Lure" 38 is chosen by a player then that player, as representing the real event of snagging a lure, must select a lure card, other than a live bait card 66, 67, from his collection of lure cards and return the lure card to the middle of the deck. Preferably, the lure card chosen by the player must be of the type that would catch a fish in the depth where the "Snag, Loose Lure" chip 38 was found. The player may draw another lure card from the top of the deck immediately before his or her next turn and the "Snag, Loose Lure" chip 38 is removed from the board.

A "No License" event chip 39 represents the real fishing event of catching a fish without a license. A player choosing a "No License" event chip 39 must release the largest fish in that player's creel by placing the fish chip on a square in that player's fishing hole. The player must also return one lure card 60–69 to the deck. The player may select another lure before that player's next turn.

A "Pesky Crappie" chip 35 represents the real fishing event wherein crappie are known to strip live bait from hooks without being caught. If a player chooses a "Pesky Crappie" chip 35 the player must return a live bait card 66, 67 to the deck of lure cards. In addition the player must return the "Pesky Crappie" chip 35 to any fishing square on game board 17 that the player chooses, including on top of another fish chip 30–39 occupying a fishing square in a fishing hole assigned to the player or an opponent. Thus, the "Pesky Crappie" chip 35 may be used by a player obtaining the chip to protect a player's own large fish from being caught by an opponent who may subsequently roll a boat 56 on die 50; the player may use the "Pesky Crappie" chip 35 to make it more difficult for an opponent to catch a fish in the opponent's fishing hole or a shared fishing hole, by placing the chip on top of another; or the player may use the "Pesky Crappie" chip 35 to delay an opponent from ending the game by placing the chip in the opponent's fishing area thereby preventing the fishing area to be depleted of chips.

In accordance with the present invention there are several embodiments in addition to the general method of play described herein above relating to levels of difficulty of play. The embodiments comprise rules particular to each level to make the game fun and challenging for different players of differing abilities.

Amateur Level

One embodiment of the present invention is where the game is played at the "Amateur" level which in addition to the general method of play includes a rule allowing live bait to catch small mouth bass in the shallow depth. As described herein above two to four players or teams of players first distribute the fish chips 30–39 face down onto fishing squares on game board 17. The players then select their fishing holes associated with a shore area 13–16 by any known method such as may be determined by the roll of the die 50. A player designated as card dealer then deals four tackle cards 60–69 to each player which comprises a player's initial "tackle box." The remaining cards remain in the stack.

The first player then rolls die 50 to determine the depth at which he will select a fish chip 30–39. Once the depth, or boat, is determined the player turns the selected chip over, and announces what type and weight of fish is represented by the indicia printed thereon. The player then inspects the lure cards in his "tackle box" to see if the player has the necessary a lure necessary to catch the fish as described in the fishing guide. If the player -possesses the necessary lure card, the player announces it to the other players and removes the fish chip from the fishing square records the weight and places it in the player's creel. If the player possesses lure card necessary to match the fish chip for the depth selected then the player still must announce the type and weight of the fish indicated (or event indicated) and replaces the chip on its original square.

A player may only have four lure cards 60–69 in the player's tackle box at a time. If the player selects a Crappie chip 35 and must return a live bait card 66, 67 to the deck as described above, or if the player selects a Snag Lose Lure event chip 38 and must return a lure card to the deck, that player may select another card from the top of the deck immediately before their next turn ensuring that the player always has four lure cards during play. A player may exchange a tackle card 60–69 by foregoing a turn and returning the preselected and unwanted tackle card to the middle of the stack and drawing another card from the top of the stack. The player may only exchange one card per turn, and may at no time have more than four lure cards in the player's tackle box.

The game ends when all the fish chips 30–39 are removed from the fishing squares in a player's fishing hole. Once the game is complete the accumulated weights of fish caught, as recorded in a player's creel, are tabulated and compared with the other player's tabulated weights. The winner of the game is determined by the player having the highest tabulated weight.

Beginner Level

Another embodiment of the present invention is a game played at the beginner level which is the easiest and fastest level of play and is representative of a child's fishing tournament in a stocked pond. The embodiment played at the basic level is similar to that played at amateur level, except that a live bait tackle card 66, 67 will also allow a small mouth bass chip 30 and average large mouth bass chip 31 to be collected, or caught, at any depth. A pike chip 32 and a lunker bass chip 34 must, as in the general method, be caught with a lure 60–65 and 68, 69, but any lure appropriate for the depth in which the fish is found as described in the fishing guide and herein above, will work. In this particular embodiment five tackle cards 60–69 are distributed to each player and the players maintain five lure cards in their respective tackle boxes at all times.

Novice Level

Yet another embodiment of the present invention is a game played at the novice level and is similar to amateur level play, except that each player maintains five lure cards in their respective tackle boxes at all times. In this particular embodiment a live bait card 66, 67 will allow a player to collect, or catch, a small mouth bass chip 30 and an average large mouth bass chip 31 in the shallow and medium depths, only. This particular embodiment is representative of a well stocked pond and is intended to play quickly and allow for interesting play by player's having a moderate level of fishing knowledge.

Professional Tournament Level

In still another embodiment of the present invention is a game played at the professional tournament which is a moderately difficult level representative of a professional fishing tournament wherein the amateur level rules apply, except that a player must select and present a lure card 60–69, or "tackle" his line, before rolling the die 50, or "casting". In this particular embodiment a player may cast a second time during the same turn, if the first cast failed to match a fish chip with the preselected lure card. To be successful a player must match the preselected lure card, the fish chip selected and the cast. This particular method may advantageously be played as "Pro" variety Bass Tournament as will be more fully described herein below.

In one embodiment of the present invention the professional tournament level is played for points in which each player begins with a set number of points, one half of which they contribute to the tournament pool as an entry fee. During the course of play, a player may risk one or more and up to 10% of the tournament pool of that player's points against the tournament pool or against any other player accepting the challenge against making a successful match of tackle, cast and roll. In accordance with the invention a successful first cast into medium or shallow water (including a boat roll) on the first try awards the player one point for each point risked. In addition a successful first cast into deep water (including a boat roll) awards the player two points for each point risked.

When the game ends, as described herein before, the points remaining in the tournament pool may go to the player who has accumulated the most points during play in a "winner take all" manner, or be distributed between the players in a preagreed manner, for example, 75% to the winner and 25% the loser in a two player game; 70% to 20% to 10% in a three player game; and 65% to 20% to 10% to 5% in a four player game. In one embodiment of the present invention for tournament level play the game may be determined to end by establishment and expiration of a predetermined time limit.

Combination Level

In still another embodiment of the present invention teams comprised of individuals having different skill levels may be form. For example, older and younger players may team up and play a combination tournament, such as a Pro/Am or Amateur/Novice or Novice/Beginner, or any other combination, with the older players subject to the more advanced rules of play described herein above. It is within the scope of the present invention that players may agree on the level of play for different players based on age, skill or experience thereby creating team, or non-team based combination level play.

Bass Tournament

In yet another embodiment of the present invention the game may be played as a representation of a Bass Tournament. The amateur level of the bass tournament is played in accordance with that level described herein above except that the winner is determined by the tabulated weight of bass caught during play. At this level the pike fish chips 32 and the crappie fish chips 33 are not placed on game board 17 leaving a total of 58 fish chips comprised of bass varieties 30, 31, 34 pesky crappie 35, and event chips 37–39 for equal distribution around the fishing squares.

The method of distribution of the reduced number of fish chips is as follows in each of the four fishing holes: fill the deep water squares first; next fill the top tier of the medium depth; next fill the squares behind the buoys, and the three squares immediately adjacent to the submerged tree; and lastly place the two remaining fish chips on any of the four remaining shallow water squares.

Note that in this embodiment the boot chip remains in the game to equalize the distribution of fish chips but has the same consequence as a "Snag Lose Lure" chip as described herein above. This embodiment may also be played without the inclusion of pesky crappie chips 35 and without the inclusion of the boot event chip 36 in order to equalize the distribution of fish chips.

In the professional level of this embodiment, the game winner may be determined on the basis of the five largest fish in each player's creel at the end of the game, as opposed to the player's total catch, representative of professional bass tournaments.

Fish Tales

In another embodiment an optional manner of play is set forth and can be played at any level. While the basic rules of play require that a player announce the type and weight of a selected fish, even if the fish is not caught. In this particular embodiment a player, after selecting a fish chip in an unsuccessful attempt may conceal the true weight and type of fish indicated on the chip and may tell a "fish tale" in an attempt to mislead the other players, who might be otherwise be inclined to make an attempt on the particular fish chip. Selected "Fish-Off" event chips 37 do not have to be removed from the board during fish tales play. However, "Snag, Lose Lure" event chips 38 are removed, since the player discloses the identify of the chip when the player returns the lost lure card to the deck.

What is claimed is:

1. A method of playing a fishing game for a plurality of players based upon fishing in a plurality of designated fishing holes arranged on a gameboard comprising:

assigning one fishing hole to each player, the fishing hole including exclusive areas and shared areas;

placing playing pieces on playing squares arranged in each of the fishing holes on the game board, the playing squares arranged as different playing areas, the playing areas including different depths of water and inaccessible playing areas, the playing pieces comprising fish chips and event chips, each of the fish chips designating a fish type and weight, and each event chip designating a fishing event;

distributing a predetermined number of playing cards to each player, the playing cards including lure cards and bait cards;

rolling a die to determine a specific playing area, the die designating different depths of water;

selecting a playing piece from the specific playing area within the exclusive area and shared areas of the assigned fishing hole except the inaccessible playing areas;

comparing the playing cards to the selected playing piece in a predetermined manner to define a match if the selected playing piece is a fish chip and recording the type and weight of the fish indicated on the selected playing piece if a match is determined, or returning the playing piece to the playing square if a match is not determined;

performing a fishing event as set forth on the selected playing piece if the selected playing piece is an event chip;

repeating the acts of distributing, rolling, selecting, comparing and performing for each player in succession until all playing pieces have been removed from a fishing hole or a predetermined amount of time has elapsed; and determining a winner based on the highest total weight of fish recorded.

2. The method as set forth in claim 1 wherein the die further designates a boat and selecting further comprises selecting a playing piece from any playing area on the gameboard except the inaccessible playing areas if rolling determines boat as the specific playing area.

* * * * *